US006202567B1

(12) United States Patent
Funk et al.

(10) Patent No.: US 6,202,567 B1
(45) Date of Patent: Mar. 20, 2001

(54) MODULAR TABLE SYSTEM WITH CABLE MANAGEMENT

(75) Inventors: David R. Funk, Sheboygan; Steven C. Gevaert, Green Bay, both of WI (US)

(73) Assignee: Krueger International, Inc., Green Bay, WI (US)

( * ) Notice: Subject to any disclaimer, the term of this patent is extended or adjusted under 35 U.S.C. 154(b) by 0 days.

(21) Appl. No.: 08/258,429

(22) Filed: Jun. 10, 1994

(51) Int. Cl.[7] ..... A47B 37/00

(52) U.S. Cl. ..... 108/50.02; 108/50.01

(58) Field of Search ..... 108/144, 50.01, 108/50.02, 50.11; 312/194, 223.1, 223.3, 223.6; 248/108.8, 108.9

(56) References Cited

U.S. PATENT DOCUMENTS

| | | | | |
|---|---|---|---|---|
| Re. 31,733 | | 11/1984 | Haworth et al. . | |
| D. 352,845 | | 11/1994 | Hellwig et al. . | |
| 3,674,230 | * | 7/1972 | Propst | 248/188.8 |
| 3,883,202 | | 5/1975 | Konig . | |
| 3,921,539 | * | 11/1975 | Berger | 248/188.8 X |
| 4,060,294 | | 11/1977 | Haworth et al. . | |
| 4,066,305 | | 1/1978 | Gazarek . | |
| 4,094,256 | | 6/1978 | Holper et al. . | |
| 4,224,769 | | 9/1980 | Ball et al. . | |
| 4,296,981 | | 10/1981 | Hildebrandt et al. . | |
| 4,323,291 | | 4/1982 | Ball . | |
| 4,370,008 | | 1/1983 | Haworth et al. . | |

FOREIGN PATENT DOCUMENTS

| | | | | |
|---|---|---|---|---|
| 2439694 | * | 3/1976 | (DE) | 248/188.8 |
| 7825906 | | 8/1978 | (DE) . | |
| 3506381 | * | 8/1986 | (DE) | 312/223.3 |
| 8712393 | | 12/1987 | (DE) . | |
| 0006707 | * | 1/1980 | (EP) | 108/50 |
| 0145410 | * | 6/1985 | (EP) | 312/223.3 |
| 563850 | * | 10/1993 | (EP) | 312/223.3 |
| 2130877 | | 6/1984 | (GB) . | |
| 2172197 | | 9/1986 | (GB) . | |
| WO 90/13239 | | 11/1990 | (WO) . | |

OTHER PUBLICATIONS

System 3000 Assembly Instructions, Krueger International, Inc., 1330 Bellevue Street, Green Bay, WI 54308–8100, 1991.

OEI, Value Added Furniture & Office Systems Serving Correctional Industries Brochure, undated.

*Primary Examiner*—José V. Chen
(74) *Attorney, Agent, or Firm*—Andrus, Sceales, Starke & Sawall, LLP

(57) ABSTRACT

A table assembly consists of a table top supported by a leg assembly, which includes a vertical tubular leg member. The leg assembly further includes a foot member mounted to the lower end of each leg via a mounting member. The length of the foot member can be varied according to the width of the table top to selectively provide different sizes of tables according to user requirements, while the mounting member is usable for all sizes of legs and foot members to mount the foot member to the leg. A power/communication housing is mounted to the underside of the table top. The housing includes first and second passages isolated from each other via a wall, with power supply cabling and communication cabling placed within the first and second passages, respectively. Power and communication receptacles are mounted to the power/communication housing, and an opening is formed in the table top for allowing power or communication cables to be passed through the table top to provide engagement with the power and communication receptacles. An access door interconnected with the power/communication housing conceals the cables fed below the table top, and also the power and communication receptacles mounted to the power/communication housing. The length of the power/communication housing and access door can be varied according to the width of the table top.

29 Claims, 7 Drawing Sheets

U.S. PATENT DOCUMENTS

| | | | | |
|---|---|---|---|---|
| 4,372,629 | | 2/1983 | Propst et al. . | |
| 4,433,884 | | 2/1984 | Edwards et al. . | |
| 4,535,703 | | 8/1985 | Henriott et al. . | |
| 4,627,364 | | 12/1986 | Klein et al. . | |
| 4,734,826 | | 3/1988 | Wilson et al. . | |
| 4,762,072 | * | 8/1988 | Boundy et al. | 108/50 |
| 4,792,881 | | 12/1988 | Wilson et al. . | |
| 4,828,513 | | 5/1989 | Morrison et al. . | |
| 4,852,500 | * | 8/1989 | Ryburg et al. | 108/50 X |
| 4,883,330 | | 11/1989 | Armstrong et al. . | |
| 5,050,267 | | 9/1991 | Quest . | |
| 5,094,174 | | 3/1992 | Grund et al. . | |
| 5,103,741 | | 4/1992 | Grund et al. . | |
| 5,144,896 | | 9/1992 | Fortsch . | |
| 5,186,425 | | 2/1993 | Keusch et al. . | |
| 5,220,871 | * | 6/1993 | Grund et al. | 108/50 |
| 5,226,705 | * | 7/1993 | Rorke et al. | 108/50 X |
| 5,230,552 | | 7/1993 | Schipper et al. . | |
| 5,231,562 | * | 7/1993 | Pierce et al. | 108/50 X |
| 5,237,935 | * | 8/1993 | Newhouse et al. | 108/50 |
| 5,272,988 | | 12/1993 | Kelley et al. . | |
| 5,277,131 | | 1/1994 | Fortsch . | |
| 5,337,657 | | 8/1994 | Diffrient . | |

* cited by examiner

MODULAR TABLE SYSTEM WITH CABLE MANAGEMENT

BACKGROUND AND SUMMARY OF THE INVENTION

This invention relates to a table or desk assembly, and more particularly to a modular training table system having cable or wire management capabilities.

Educational settings, whether in a classroom, business or other institution, increasingly utilize computers or other electronic equipment. The present invention contemplates a table or desk system especially well suited for this type of setting, in which a computer or other electronic device is placed on a work surface.

It is an object of the present invention to provide a table or desk system which includes cable or wire management capabilities for accommodating power and/or communication cabling interconnected with a computer or other electronic or electrical device placed on the work surface. It is a further object of the invention to provide such a system in which a series of tables or desks can be placed in a side-by-side manner, and in which the power and/or communication cables can extend between adjacent tables. It is another object of the invention to provide a table or desk system in which the size of certain components making up each individual table or desk can be varied according to user requirements, while utilizing a common set of core components, to provide a modular system for constructing a table or desk having a selected configuration dictated by the user. Yet another object of the invention is to provide a table or desk system in which a minimum number of components are exposed in order to prevent such components from being tampered with by users.

In accordance with one aspect of the invention, a table assembly includes a table top defining an upper surface and a lower surface, and leg structure interconnected with the table top for supporting the table top above a supporting surface. A power/communication supply system is located below the table top, and includes a housing defining an internal passage for receiving one or more power supply cables, and one or more power supply receptacles mounted to the housing and interconnected with the one or more power supply cables. A passage is formed in the table top for routing one or more power cables below the table top from a computer or other device supported thereby, for enabling engagement of the power cable with one of the power supply receptacles. The power/communication system housing is preferably in the form of an elongated beam-type extrusion member which extends between the ends of the table top and which is mounted to the underside of the table top. The housing preferably also defines a second internal passage, isolated from the first internal passage and coextensive therewith, which is adapted to receive one or more communication cables. One or more communication receptacles are interconnected with the communication cables and mounted to the housing, and a communication cable from the computer or other device is connectable to the communication receptacle for providing voice or data signals to and from the device. The beam-type structure includes a transverse wall which separates the first internal passage from the second internal passage, and a closure is interconnected with the transverse wall and with the upper and lower portions of the extrusion member for closing the first and second internal passages. The power supply and communication receptacles are preferably mounted to the closure. A cover is engageable with the underside of the table top and with the extrusion member, and is located so as to enclose cables extending through the passage in the table top and engaged with the power supply and communication receptacles. The cover is movable between an open position providing access to the power and communication receptacles and to the power supply and communication cables, and a closed position preventing access thereto. The first and second ends of the housing each include an opening which enables power supply and communication cables to pass therethrough into first and second internal passages of a similarly constructed housing of an adjacent table. The housing ends are preferably flush with the side edges of the table so as to butt against the housing of an adjacent table when the tables are placed adjacent each other. The leg structure includes a tubular member which defines an upper end located adjacent the housing and a lower end disposed therebelow. The tubular member includes an internal passage extending between the upper and lower ends, and an opening is formed in the upper end of the tubular member. The closure is constructed so as to terminate inwardly of the housing ends, for establishing communication between the tubular member upper end and the first and second passages of the housing. In this manner, cables can be routed between the housing and the leg internal passage. The leg further includes an opening in its lower end which enables cables to pass to the exterior of the leg, for interconnection with a wall outlet or receptacle located adjacent the table leg.

The above-summarized structure provides a compact and efficient arrangement for supplying power and/or communication capability to a location adjacent the underside of a table top, and minimizes the presence of exposed cords or cables externally of the table system.

In accordance with another aspect of the invention, the length and width of the table top is selected according to the requirements of an end user. The extrusion member forming a part of the power/communication supply system housing is capable of being cut to length according to the length of the table top. Support structure is interconnected with the table top for supporting the table top above a supporting surface. The support structure includes a leg interconnected with and depending from the table top, an axial foot member having a length selected according to the width of the table top, and mounting structure for mounting the foot member to the leg. The axial foot member is preferably a length of tubing defining first and second open ends and at least an upper surface extending therebetween. The mounting structure is in the form of a mounting member engaged with the upper surface of the axial foot member, and the lower end of the leg is engaged with the mounting member. The mounting member is preferably engaged toward the rearward end of the foot member, and extends in a front-rear direction less than the length of the foot member. Threaded fasteners are employed to connect the mounting member to the foot, and to connect the lower end of the leg to the mounting member. End caps are engaged with each end of the axial foot member. Each end cap includes a first internal portion which extends into the open end of the foot member, and which is secured thereto via threaded fasteners or the like, and a second external portion which extends outwardly from the foot member end. A glide member is engaged with the external portion of each end cap, and an adjustment member is interposed between the end cap external portion and the glide member for use in leveling the table top. In this manner, the length of tubing forming a part of the foot member is selected according to the width of the table top in order to provide adequate support to the table top. The mounting member is capable of mounting an axial foot member of any length to the lower end of the leg, according to user requirements.

The invention further contemplates a method of constructing a table, substantially in accordance with the foregoing summary.

Preferably, the above-summarized aspects of the invention are all incorporated into a single table assembly, in combination, to provide an efficient cable management system and to maximize flexibility in design of the table. However, the separate aspects of the invention could be used independently of each other, and each provides advantages in design, assembly and/or operation of the table.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
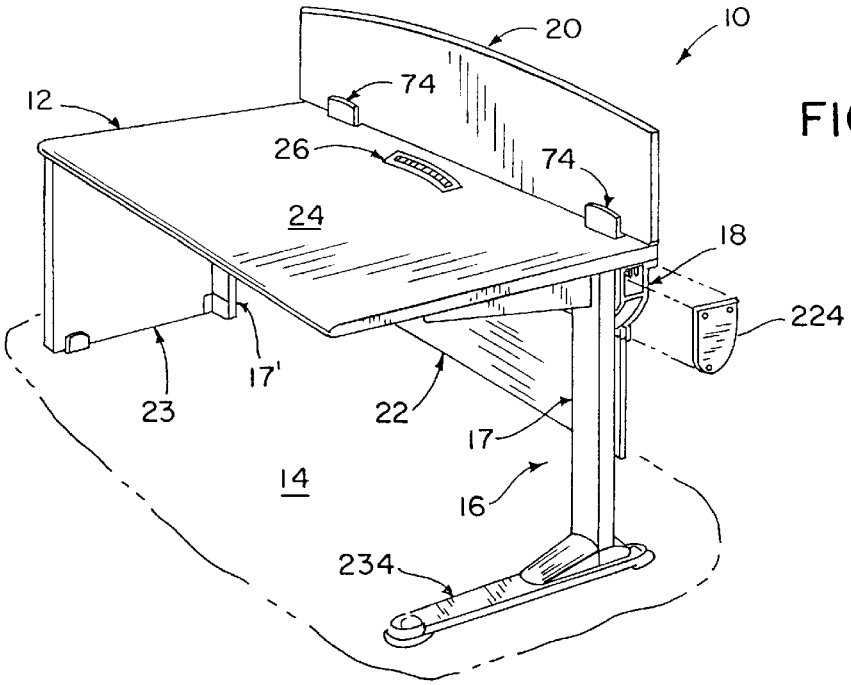
FIG. 1 is an isometric view of a table or desk assembly constructed according to the invention.
Figure 2:
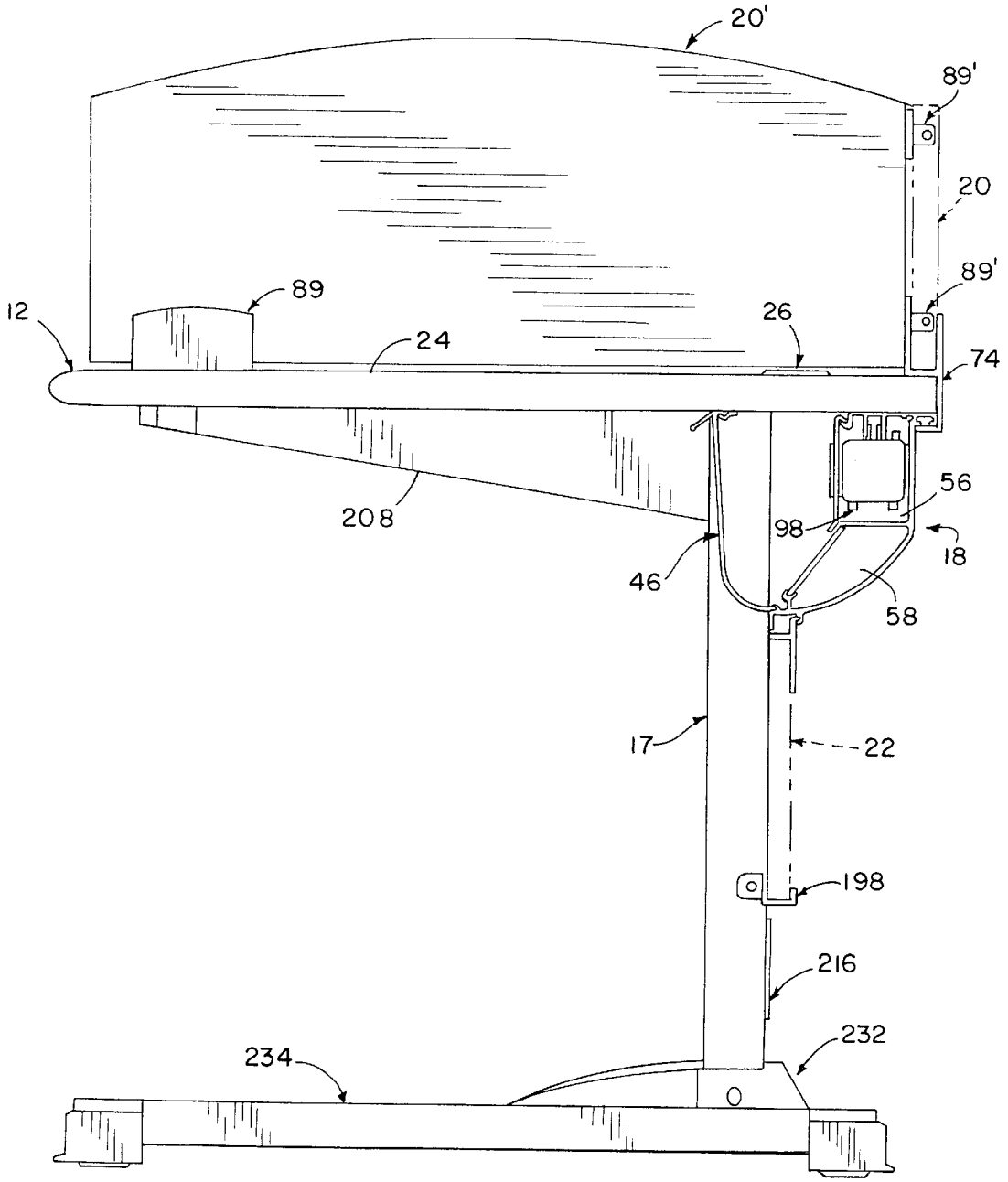
FIG. 2 is a side elevation view of the table assembly of FIG. 1.

FIGS. 1 and 2 illustrate a desk or table assembly 10 constructed according to the invention. Hereafter, the invention will be referred to as a table assembly, with the understanding that the invention could also be designated a desk assembly in that it performs a similar function by providing a work surface supported above a floor or other supporting surface. Generally, table assembly 10 includes a work surface or table top 12 supported above a floor 14 at one end by a leg assembly 16 including a vertical leg member 17. Table assembly 10 further includes a power/communication housing 18, a vertical privacy panel 20 and a modesty panel 22. At the end of table assembly 10 opposite leg assembly 17, a vertical leg 17', similar to leg member 17, engages floor 14 to support table top 12. An end partition panel 23 is mounted to the lower surface of table top 12 and to leg 17', and engages floor 14.

Table assembly 10 is well suited for use in an educational environment, such as in a school or university setting or in a corporate or other institutional training facility. Alternatively, table assembly 10 is equally well suited as a stand-alone unit in an office or work place environment. Table top 12 defines an upper surface 24 which is well suited to support a computer or other electronic or electrical device used in an educational or training setting.

Figure 3:
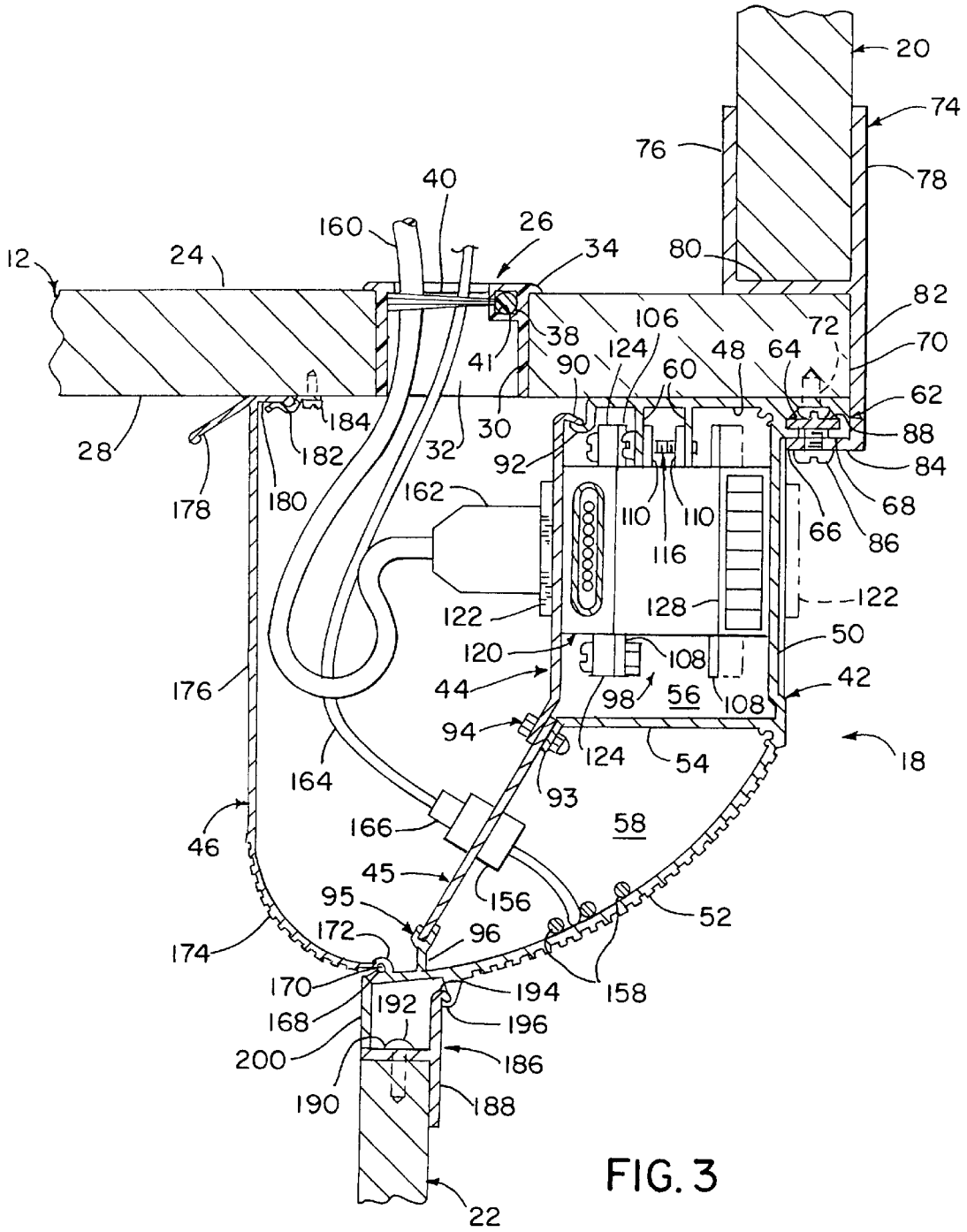
FIG. 3 is an enlarged partial section view showing the power and communication housing of the table assembly of FIG. 1.

As shown in FIGS. 1 and 3, a grommet assembly 26 is engaged within a slot or opening formed in table top 12, extending between its upper surface 24 and its lower surface, shown in FIG. 3 at 28. Grommet assembly 26 includes a side wall 30 having a shape corresponding to that of the opening formed in table top 12, defining a passage 32 which extends between table top upper and lower surfaces 24, 28, respectively. Side wall 30 includes a peripheral flange 34 at its upper end which engages table top upper surface 24 to retain grommet assembly 26 in position on table top 12. A brush assembly, including a header 38 from which a series of bristles 40 extend, is mounted to grommet assembly 26 via a series of walls formed integrally with side wall 30 and defining a passage 41 within which header 38 is received. The vertical wall facing passage 32 defines a slot through which bristles 40 extend. With this construction, bristles 40 prevent objects from falling into passage 32 from upper surface 24, while accommodating passage of cords or cables through passage 32 from a device placed on table top upper surface 24, as will be explained.

Referring to FIG. 3, power/communication housing 18 includes an extrusion member 42, a pair of closure plates 44, 45, and an access door or cover 46. Extrusion member 42 includes an upper portion defined by a horizontal top wall 48 and a vertical side wall 50, and a lower portion defined by an arcuate bottom wall 52. A transverse wall 54 is disposed between vertical wall 50 and bottom wall 52, to separate the upper and lower portions of extrusion member 42. Top wall 48, vertical side wall 50 and transverse wall 54 cooperate to define an upper passage 56, and bottom wall 52 and transverse wall 54 cooperate to define a lower passage 58.

A pair of ribs 60 are formed integrally with top wall 48.

A mounting tab 62 extends rearwardly from the intersection of vertical wall 50 and top wall 48. Tab 62 extends along the length of extrusion member 42, being formed integrally therewith, and includes a channel 64 and a pair of facing lips 66, 68. Extrusion member 42 is mounted to table top 12 such that the upper surface of top wall 48 engages table top lower surface 28, with extrusion member 42 being positioned toward the rearward edge of table top 12. The rearward edge of tab 62 is aligned substantially flush with the rearward edge of table top 12, shown at 70. Threaded fasteners, such as screws 72, are then driven into table top 12, with the heads of screws 72 being disposed within channel 64 and engaging the horizontal upper surface of channel 64.

Privacy panel 20 is mounted to the rearward edge of table top 12 via a pair of brackets 74 (FIGS. 1, 3). Each bracket 74 includes a pair of spaced walls 76, 78 and a lower wall 80 which define a U-shaped channel, within which panel 20 is received. A wall 82 extends vertically from the lower end of wall 78, and engages rearward edge 70 of table top 12, extending past tab 62. A lower horizontal wall 84 extends forwardly from the lower end of vertical wall 82. Bracket 74 is mounted to tab 62 by one or more bolts 86 which extend through one or more openings formed in lower horizontal wall 84 and into engagement with plate-like nuts 88 placed within channel 64 and which engage lips 66, 68. Tightening of bolts 86 clamps lower wall 84 to extrusion member tab 62 to securely mount bracket 74, and thereby privacy panel 20, to the rearward edge of table top 12.

As shown in FIG. 2, an end privacy panel 20' may be mounted to one or both of the ends of table top 12. A bracket assembly 89, constructed similarly to bracket assemblies 74, engages one end of end privacy panel 20', which is secured at its rearward end via connectors 89' to the end of privacy panel 20. Alternatively, if end panels 20' are employed without rear privacy panel 20, a bracket assembly such as 89 is mounted to table top 12 adjacent its rearward end for mounting the rearward end of each privacy panel 20'.

Housing upper and lower passages 56, 58, respectively, open forwardly toward the front edge of table top 12. Upper passage 56 is closed by closure plate 44, and lower passage 58 is closed by closure plate 45. The upper end of closure plate 44 includes a downturned lip 90, which engages an upturned lip 92 formed at the forward end of extrusion member top wall 48. The lower end of closure plate 44 and the upper end of closure plate 45 are mounted to a downturned forward end tab, shown at 93, provided on extrusion member bottom wall 52, via a series of nut and bolt assemblies, shown at 94. The lower end of closure plate 45 is received within a channel 95 located at the upper end of a rib 96, formed integrally with extrusion member 42. Closure plates 44, 45 are removably secured to extrusion member 42 by first engaging upper downturned lip 90 of closure plate 44 with extrusion member lip 92 and engaging the lower end of closure plate 45 within channel 95. The lower end of closure plate 44 and the upper end of closure plate 45 are then positioned adjacent end tab 93, with the upper end of closure plate 45 being positioned between tab 93 and the angled lower end of closure plate 44. Nut and bolt assemblies 94 are then employed to secure the lower end of closure plate 44 and the upper end of closure plate 45 to tab 93 via aligned openings formed therein. Closure plates 44, 45 are removed by reversing the above steps, in order to gain access to passages 56, 58.

Figure 4:
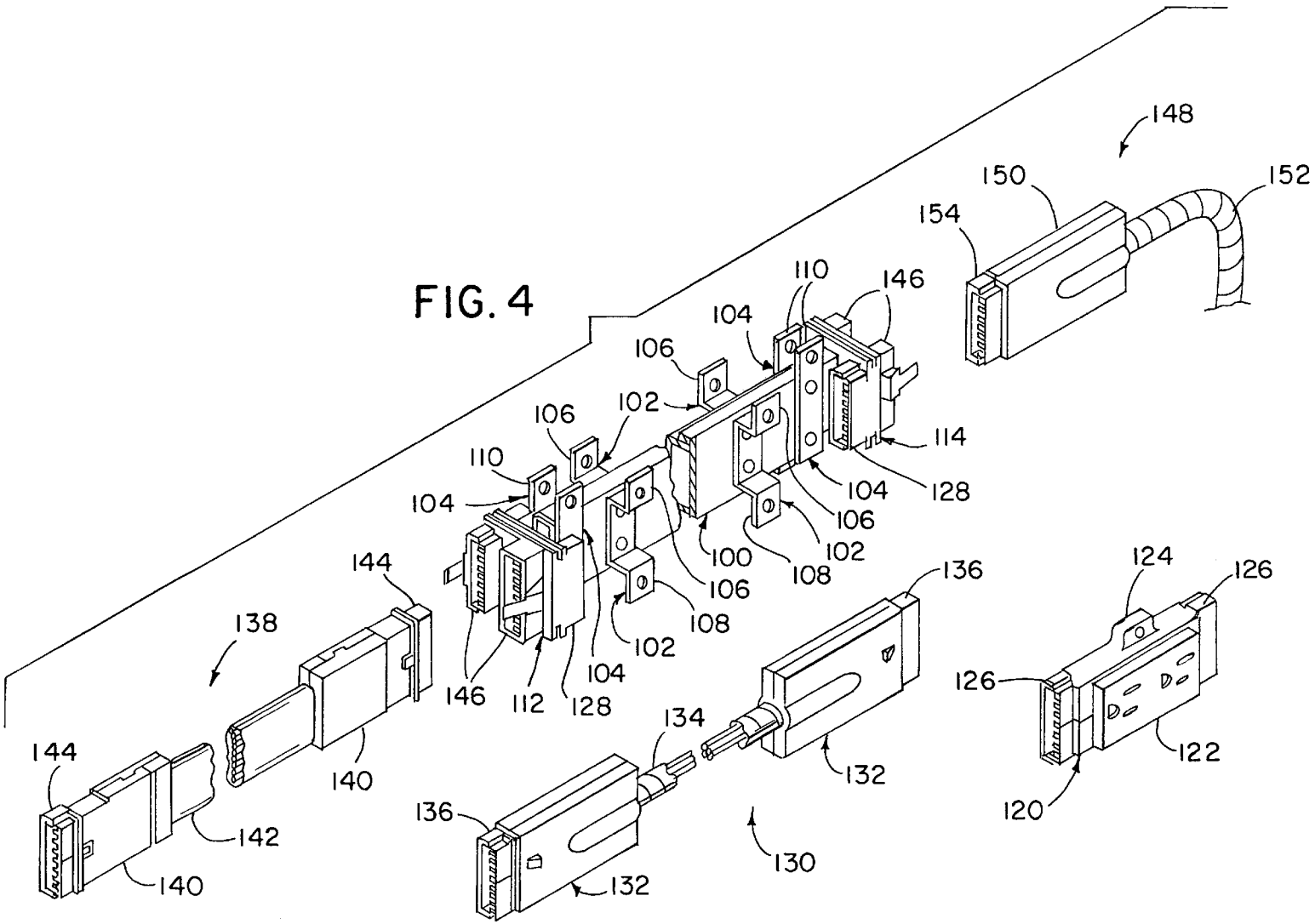
FIG. 4 is an exploded perspective view showing details of the electrical power distribution system mounted within the power supply portion of the housing of FIG. 3.

Referring to FIGS. 3 and 4, an electrical power distribution system 98 is located within extrusion member upper passage 56. Power distribution system 98 includes an axially extending structural tubular member 100 to which a series of brackets 102 and plates 104 are mounted at various intervals along its length. Brackets 102 include upper and lower mounting tabs 106, 108 which extend respectively above and below the upper and lower edges of tubular member 100. Mounting plates 104 include upper mounting portions 110 which extend upwardly above the upper edge of tubular member 100. A pair of connector assemblies 112, 114 are mounted to the ends of tubular member 100.

Tubular member 100 has a length determined according to the length of extrusion member 42, such that connector assemblies 112, 114 are located adjacent and inwardly of the ends of extrusion member 42. Tubular member 100 is mounted to extrusion member ribs 60 via screws 116 (FIG. 3) which extend through aligned threaded openings formed in ribs 60 and in mounting portions 110 of plates 104. With this construction, tubular member 100 and its associated components, including brackets 102 and electrical connectors 112, 114, are suspended in passage 56 from extrusion member upper wall 48.

An electrical receptacle assembly 120 including an outwardly facing receptacle portion 122 is adapted for mounting to mounting tabs 108 of brackets 102 via upper and lower ears, such as 124. Receptacle assembly 120 includes conventional male connecting structure 126, and conventional mating female connecting structure 128 is provided on each connector assembly 114. Mating structures 126, 128 enclose mating power terminals for communicating electrical power to and from receptacle assemblies 120 and connector assemblies 112, 114.

As shown in FIGS. 3 and 4, receptacle portion 122 of each receptacle assembly 120 is received within an opening formed in closure plate 44 so as to extend outwardly therefrom. Optionally, one or more receptacles may also extend through openings formed in extrusion member rear vertical wall 50, as shown in phantom in FIG. 3.

Receptacle assemblies 120 are provided adjacent the ends of tubular member 100, so as to be disposed adjacent the ends of extrusion member 42. Additional receptacle assemblies 120 may be interspersed along the length of tubular member 100 at any desired location along the length of extrusion member 42, being mounted to additional bracket assemblies 102 secured to tubular member 100.

A power supply assembly 130 (FIG. 4) spans between receptacle assemblies 120. Each power supply assembly 130 includes a pair of connectors 132 at its ends, between which a conduit 134 extends, which encloses cabling communicating electrical power between connectors 132. Connectors 132 include mating structure 136 enclosing electrical power terminals, which is engageable with mating structure 126 on receptacle assemblies 120 and with mating structure 128 on connectors 112, 114. The length of conduit 134 is selected according to the distance power supply assembly 130 spans between receptacle assemblies 120, between a receptacle 120 and one of connectors 112 or 114, or between connectors 112, 114. Power supply assemblies 130 provide a continuous supply of power between connectors 112, 114.

A pair of jumper assemblies 138 interconnect the electrical power system of one table assembly 10 with that of an adjacent table assembly. Each jumper assembly 138 includes connectors 140 at its ends and a rigid conduit 142 extending therebetween, housing electrical cabling communicating electrical power between connectors 140. Connectors 140 include mating structure 144 at their ends enclosing electrical power terminals and engageable with outwardly facing mating structure, shown at 146, provided on connectors 112, 114. Jumper assemblies 138 thus provide a continuous supply of electrical power between adjacent table assemblies.

A pair of electrical supply assemblies 148, each of which includes a connector 150 and a flexible conduit 152, are interconnected with connector 114 at a location where electrical power is to be communicated to the electrical supply assemblies 98 and jumper assemblies 138. Each connector 150 includes mating structure 154 enclosing electrical power terminals and engageable with mating structures 146 for supplying electrical power to connectors 112, 114. In a manner to be explained, conduit 152 is interconnected with a conventional stationary floor-mounted or wall-mounted electrical receptacle.

As shown in FIG. 3, one or more communication receptacles 156 are mounted to lower closure plate 45 which encloses lower passage 58. Communication cables 158 placed within lower passage 58 are interconnected with communication receptacles 156.

With the construction of table assembly 10 and power/communication housing 18 as shown and described, a power cable 160 from a computer or other electronic or electric device placed on table top upper surface 24 extends through grommet passage 32, such that its plug 162 can be engaged with power receptacle 120 for providing electrical power to the computer or other device to which power cable 160 is connected. Similarly, a communication cable 164 extends through grommet passage 32 such that its plug 166 can be engaged with communication receptacle 100, to provide voice and/or data communication to the device to which communication cable 164 is connected.

Brush bristles 40 accommodate passage of cables 160, 164 through grommet passage 32, and function to fill grommet passage 32 in order to prevent objects or dust from falling into and through grommet passage 32.

As shown in FIG. 3, the passage formed in table top 12 within which grommet assembly 26 is engaged is located so as to be slightly forward of power/communication housing 18. With housing 118 being located toward the rearward-most end of table top 12, grommet assembly 26 can likewise be located toward the rearward end of table top 12 so as to provide a clear surface forwardly thereof to provide ample room for placing computers or other devices on table top upper surface 24.

Access door or cover 46 functions to enclose the forward facing portions of power/communication housing 18 and the portions of cables 160, 164 which extend below lower surface 28 of table top 12. Access door 46 includes a longitudinal bead 168 at its lower end, received within a channel 170 defined by a curved wall 172 forming a part of extrusion member 42, to mount access door 46 to extrusion member 42. A ribbed arcuate living hinge 174 is formed at the lower portion of access door 46, and a panel 176 is disposed between the upper end of living hinge 174 and a handle 178, which extends downwardly and forwardly from the upper end of panel 176. A tab 180 having a protrusion at its end extends rearwardly from the upper end of panel 176.

Access door 46 is a dual durometer extrusion, in which living hinge 174 is formed of a resilient, flexible PVC material and panel 176, and handle 178 and tab 180 are formed of an inflexible, hard PVC material, in a manner as is known.

A series of spring clips, such as 182, are connected to table top lower surface 28 via a series of screws 184 forwardly of grommet 26. Each clip 124 includes a recessed portion adapted to receive the protrusion at the end of tab 180, to maintain access door 46 in its closed position as shown in FIG. 2. When a user requires access to cables 160 or 164, the user grasps handle 178 and pulls the upper end of access door 46 forwardly, disengaging the protrusion on tab 180 from clip 182. Living hinge 174 enables door 46 to be pivoted to an open position. Access door 46 is moved to its closed position of FIG. 2 by reversing the above steps and utilizing handle 178 to engage the protrusion on tab 180 with the recess in spring clip 182. The resiliency of spring clip 182 ensures engagement between spring clip 182 and the protrusion on tab 180 in order to maintain door 46 in its closed position.

As noted, door 46 provides access to power receptacles 120 and to communication receptacles 156. In addition, access door 46 in its open position enables channels 56 and 58 to be accessed by disengaging bolts 94 from extrusion member lip 96, in the event receptacles 120, 156 or cables 160, 164 require service or replacement.

As further shown in FIG. 3, modesty panel 22 is mounted to extrusion member 42 via one or more brackets 186, each of which includes a vertical plate 188 and a horizontal leg 190. Modesty panel 122 is mounted to each bracket 186 via a series of screws 192 extending through horizontal leg 190 into the upper end of modesty panel 22. A hook 194 is formed at the upper end of vertical plate 188, and is engageable with a hook 196 formed on extrusion member 42. Modesty panel 22 and brackets 186 are mounted to table assembly 10 by first engaging hook 194 with hook 196, and then rotating panel 22 toward leg assembly 16 until panel 22 engages legs 17, 17'. Modesty panel 22 is then secured to legs 17 and 17' via brackets 198 (FIG. 2) engaged with the lower end of modesty panel 22. Modesty panel 22 is removed by reversing the above-noted steps.

A vertical plate 200 is formed at the lower forward end of extrusion member 42, to fill the space between the lower end of access door 46 and the upper end of modesty panel 22.

Figure 5:
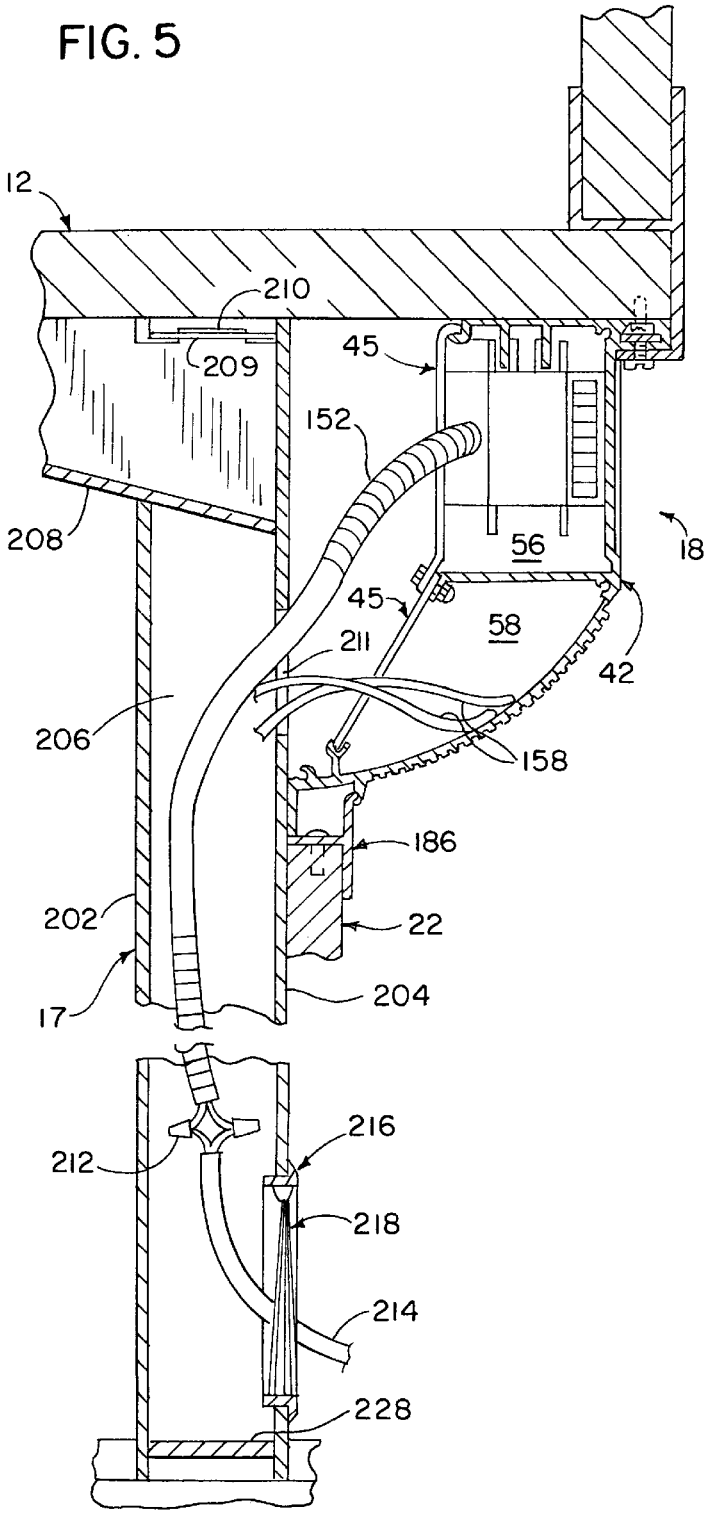
FIG. 5 is a partial section view showing the power and communication housing toward the end of the table and communication between the housing and the vertical leg.
Figure 6:
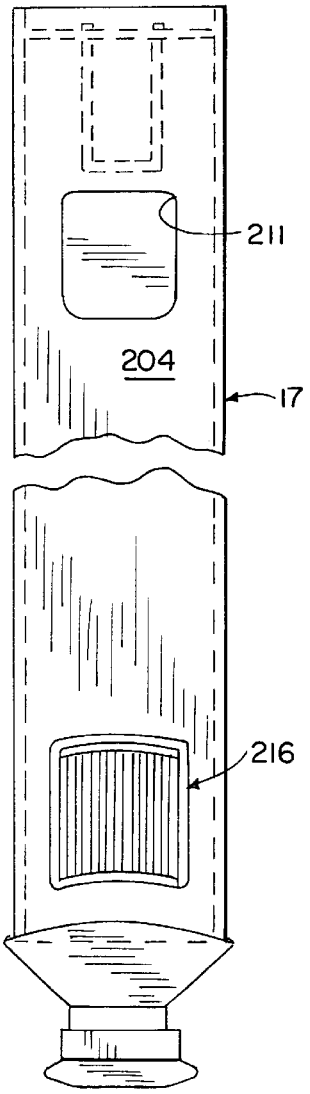
FIG. 6 is an elevation view of the vertical leg of the table of FIGS. 1 and 5.
Figure 7:
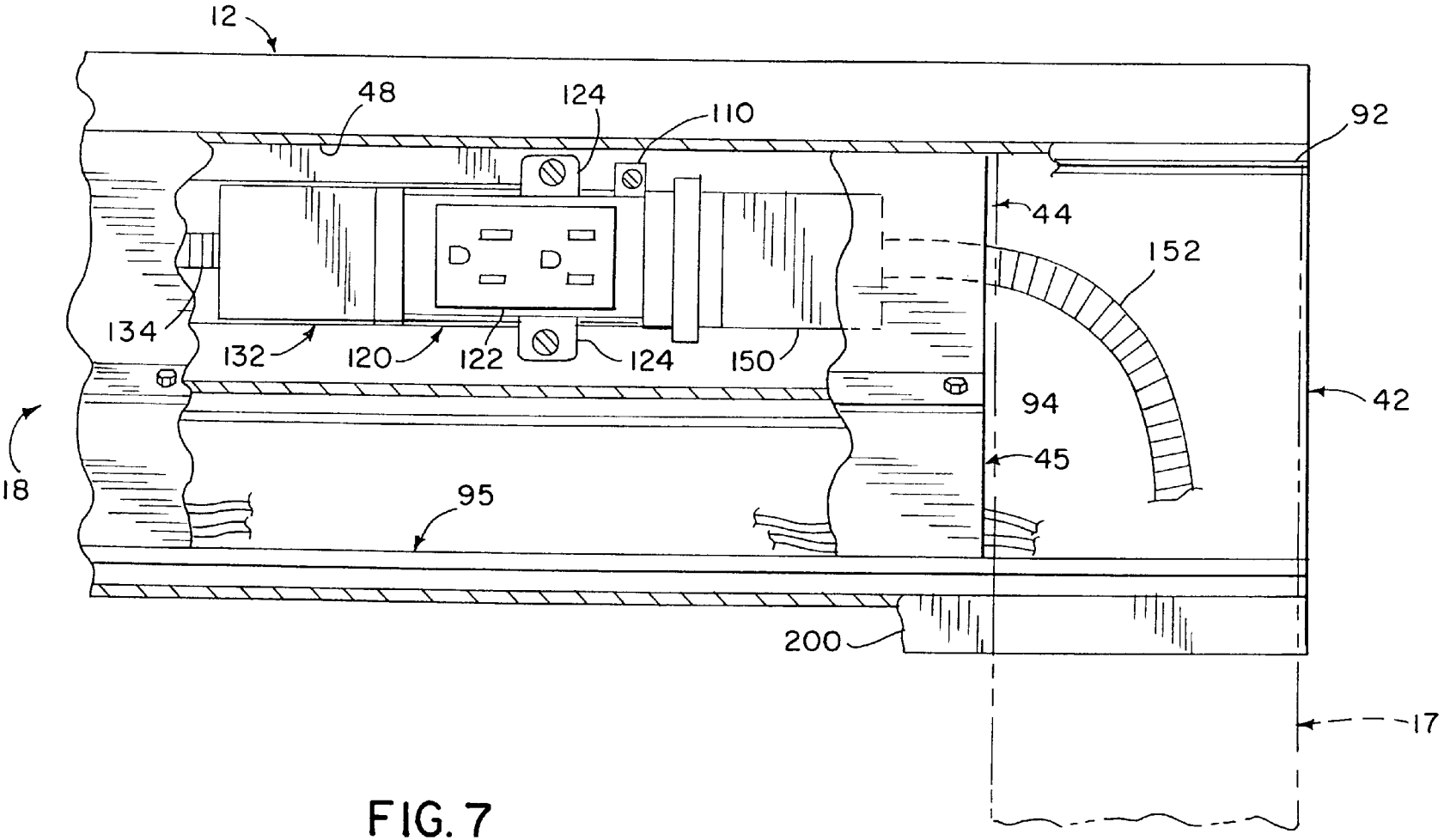
FIG. 7 is a partial front elevation view, with portions broken away, showing communication between the housing and the vertical leg.
Figures 10, 11, 12:
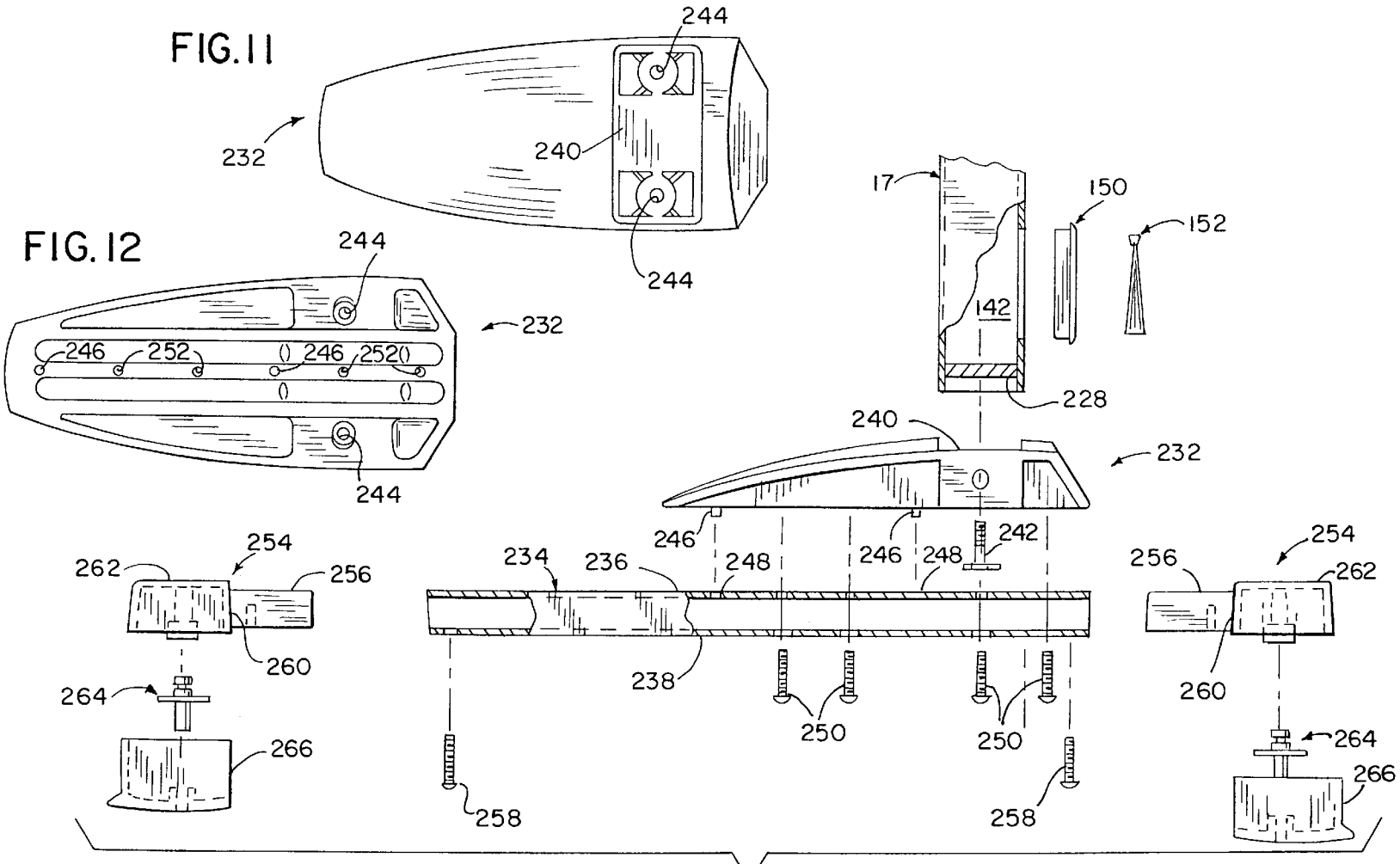
FIG. 10 is an exploded side elevation view showing the axial foot member of the table of FIG. 1 and the manner in which it is mounted to the lower end of the vertical leg.
FIGS. 11 and 12 are top and bottom plan views, respectively, of the mounting member used to mount the axial foot member to the lower end of the vertical leg.

FIGS. 5 and 7 illustrate the end portion of power/communication housing 18 adjacent leg 17. As shown, leg 17 is in the form of a tubular member having side walls 202, 204 and a pair of spaced end walls extending between side walls 202 and 204, all of which cooperate to define an internal passage 206. The upper end of leg 17 engages table top lower surface 28, and passage 206 extends vertically downwardly therefrom. An arm 208 is mounted to the upper end of leg 17, extending forwardly therefrom. Arm 208 engages table top lower surface 28 for supporting table top 12. Arm 208 is received within a U-shaped slot formed in leg wall 202. A locking plate 209 is welded to the inner surface of leg sidewalls 202, 204 and end walls extending therebetween to secure arm 208 to leg 17. The inner end of arm 208 includes a pair of ears 210, which are received within a pair of slots formed in locking plate 209.

As noted previously, extrusion member 42 extends between the side edges of table top 12, such that its ends are substantially flush therewith. As best seen in FIG. 7, upper closure plate 44 and lower closure plate 45 terminate inwardly of the end of extrusion member 42. The ends of upper and lower closure plates 44, 45 terminate adjacent the inner edge of leg 17, so that upper and lower passages 56, 58, respectively are exposed behind leg 17. An opening 211 (FIG.5) is formed in the upper end of leg member rear wall 204, and is disposed so as to be in horizontal alignment with extrusion member passages 56, 58. With this construction, power cable conduit 152 and communication cables 158 can be passed from passages 56, 58, respectively, into leg internal passage 206 through opening 211.

At the lower end of conduit 152, the electrical wires housed by conduit 152 are pigtailed and connected by conventional wire connectors, such as 212, to the wires of a power cable 214. A bezel 216 having a brush assembly 218 is mounted within an opening formed toward the lower end of leg 17, providing access to leg internal passage 206. Power cable 214 and communication cables 158 can thus be passed out of leg 17 through bezel 212 and brush assembly 152 in order to provide interconnection with wall-mounted or floor-mounted power and communication receptacles or the like.

Figure 8:
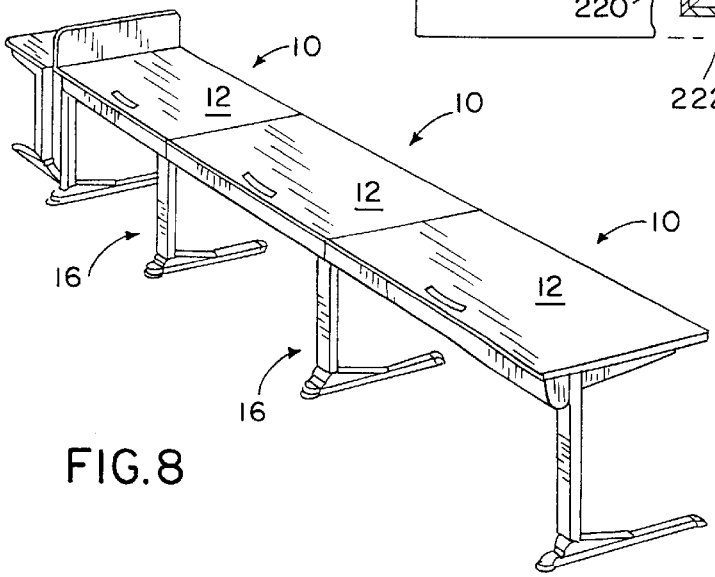
FIG. 8 is an isometric view illustrating a series of tables constructed similarly to the table of FIG. 1, placed in a side-by-side manner.

Referring to FIG. 8, a series of table assemblies 10 can be placed in a side-by-side manner such that the side edges of adjacent table tops engage each other. Power/communication housing 18 has a length substantially equal to that of each table top so that, when the table assemblies 10 are placed side-by-side, the power/communication housings of adjacent table assemblies face and open toward each other. This feature of the invention enables jumper assemblies 138 and communication cables 158 to extend from one power/communication housing 18 to the adjacent power/ communication housing through the open ends of each housing. This construction provides an efficient and compact arrangement for passing power and communication cabling from one table assembly to another without exposed cabling. As shown in FIG. 8, a leg assembly 16 spans the joint between adjacent ends of adjacent table tops 12, such that one leg assembly 16 supports the adjacent ends of two table tops in a row of table assemblies 10.

Figure 9:
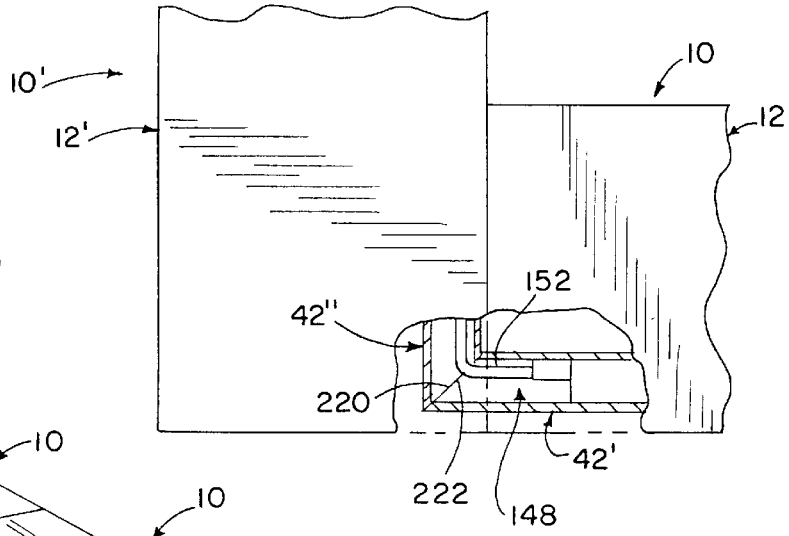
FIG. 9 is a partial top plan view, with a portion broken away, showing the relationship between the power/communication supply housings of adjacent tables placed at right angles to each other.

FIG. 9 illustrates a construction in which a table assembly 10 and a table assembly 10' are oriented at right angles to each other. In this arrangement, an extrusion member 42', having a cross-section identical to that of extrusion member 42 (FIG. 3) is mounted to the lower surface of table top 12 of table assembly 10, extending outwardly past the side edge of table top 12. Extrusion member 42' terminates in an angled end 220 located below the lower surface of the table top, shown at 12', of table assembly 10'. Table assembly 10' includes an extrusion member 42", also having a cross-section identical to that of extrusion member 42 (FIG. 3), and terminating in a complementary angled end 222. With this construction, complementary ends 220, 222 of extrusion members 42', 42", respectively, cooperate to establish communication between the upper and lower passages of extrusion members 42', 42". A connector assembly 148 having a flexible conduit 152 is employed in this situation to convey power from table assembly 10 to table assembly 10', with conduit 152 providing sufficient flexibility to bend the 90° angle defined by extrusion members 42', 42" when ends 220, 222 are placed together.

At the endmost table assembly 224, a cap plate 224 (FIG. 1) is engaged with power/communication housing 18 to enclose passages 56 and 58. Cap plate 224 can selectively be removed as needed in order to provide access to passages 56, 58 to reroute cabling, or for any other reason.

The construction of leg assembly 16 is illustrated in detail in FIGS. 1, 2 and 10–12. As noted previously, leg 17 is a tubular member defined by side walls 202, 204 and a pair of spaced end walls extending therebetween. The length of leg 17 can be varied according to user requirements, to provide variability in the height of table top 12 above floor 14. At the lower end of leg 17, a plate 228 is welded to the inner surfaces of the walls of leg 17. A pair of threaded vertical passages (not shown) are formed in plate 228. A mounting member, shown at 232, is positioned between the lower end of leg 17 and an axially extending horizontal foot member 234.

Foot member 234 consists of a length of tubing defined by upper and lower walls 236, 238 and a pair of spaced side walls extending therebetween. Mounting member 230 is a one-piece member, preferably an aluminum casting, and includes a recess 240 within which the lower end of leg 17 is received. A pair of bolts 242 extend through vertical passages 244 formed in mounting member 232 into engagement with the threaded vertical passages in plate 228, to secure mounting member 232 to the lower end of leg 17. Mounting member 232 further includes a pair of depending bosses 246 which are engageable within openings 248 formed in foot member upper wall 236, for locating mounting member 232 relative to foot member 234. A series of bolts 250 extend through aligned openings formed in foot member upper and lower walls 236, 238, respectively, and into vertical threaded passages 252 (FIG. 12) extending upwardly from the lower surface of mounting member 232. Foot member 234 is thus mounted to leg member 17 via a sequential mounting operation in which mounting member 232 is first mounted to the lower end of leg 17, and foot member 234 is then mounted to the lower surface of mounting member 232.

The ends of foot member 234 are open, and a pair of end caps 254 are engaged with the ends of foot member 234. Each end cap 254 includes an internal portion 256 which is received within an open end of foot member 234. Bolts 258 extend through openings formed in foot member lower wall 238 and into vertical threaded passages formed in end cap internal portion 256, to mount end caps 254 to the ends of foot member 234. A shoulder 260 engages the end of foot member 234. Each end cap 254 further includes an external portion 262 which extends outwardly from the end of foot member 234. External portion 262 includes a vertical passage adapted to receive a leveling screw 264, with the passage opening onto the upper surface of external portion 262. A floor-engaging toe member 266 is secured to end cap external portion 262 via leveling screw 264, and the vertical position of toe 266 relative to external portion 262 is adjustable by turning screw 264 to level table top 12.

With this construction, the length of foot member 234 can easily be changed according to the width of table top 12, while utilizing the same end caps 254 and mounting member 232 regardless of the length of foot member 234.

The above-described table assembly is extremely modular, versatile and flexible. An end user can select any size of table top 12 according to specific requirements, preferably from a number of preselected sizes. Once the size of table top 12 is determined, the height of leg member 17 is selected, and the length of foot member 234 is selected in order to provide adequate stability to the table assembly. Power/communication extrusion member 42 is cut to size according to the length of the table top, as are closure plates 44, 45. Access door 46, being an extruded member, can likewise be cut to any desired length according to the spacing between the legs of table assembly 10. It can thus be appreciated that certain components making up table assembly 10 can easily be changed to accommodate user requirements, while maintaining the basic configuration and construction of such components substantially identical between different assemblies in order to minimize cost of manufacture. The power/communication capability provided to table assembly 10 via power/communication housing 18 constitutes an added benefit in the modularity of the components of table assembly 10, by providing an efficient and easily variable arrangement for providing power and communication to devices supported by the table top.

Various alternatives and embodiments are contemplated as being within the scope of the following claims particularly pointing out and distinctly claiming the subject matter regarded as the invention.

We claim:

1. A table assembly, comprising:

a table top defining an upper surface and a lower surface and spaced side edges;

leg structure interconnected with the table top for supporting the table top above a supporting surface;

a power supply system disposed below the table top and including a housing mounted to the table top, the housing defining first and second ends, each of which is located adjacent one of the table top side edges, and wherein the housing includes wall structure extending between the first and second housing ends defining a first internal passage extending between the housing ends for receiving one or more power supply cables, and one or more power supply receptacles mounted to the housing, wherein the housing wall structure further defines a second internal passage extending between the housing ends for receiving one or more additional cables, and wherein the wall structure functions to isolate the second passage from the first passage;

a passage formed in the table top for routing one or more cables below the table top from a location above the table top for engagement with the one or more power supply receptacles;

wherein the housing comprises an extrusion member and wherein the wall structure defines an upper wall, a side wall, and first and second transverse walls, wherein the upper wall, side wall and first transverse wall define in part the first passage, and wherein the first transverse wall separates the first passage from the second passage.

2. The table assembly of claim 1, further comprising closure wall structure having an upper portion engaged with the extrusion member upper wall; a lower portion engaged with the extrusion member second transverse wall; and an intermediate portion engaged with the extrusion member first transverse wall; wherein the closure wall structure functions to enclose the first and second passages.

3. The table assembly of claim 2, wherein the one or more additional cables comprises a communication cable, and wherein at least one of the power supply receptacles are mounted to the closure wall structure enclosing the first passage, and further comprising one or more communication receptacles mounted to the closure wall structure enclosing the second passage.

4. A table assembly, comprising:

a table top defining an upper surface and a lower surface;

leg structure interconnected with the table top for supporting the table top above a supporting surface;

a power supply system disposed below the table top and including a housing mounted to the table top, the housing defining an internal passage for receiving one or more power supply cables, and one or more power supply receptacles mounted to the housing;

a passage formed in the table top for routing one or more cables below the table top from a location above the table top for engagement with the one or more power supply receptacles; and a cover movably mounted to the power supply system housing and releasably engaged with the lower surface of the table top, wherein the cover is located such that the passage is disposed between the housing and the cover when the cover is engaged with the underside of the table such that the cover encloses cables extending through the passage in the table top and engaged with the one or more power supply receptacles, wherein the cover is movable between an open position providing access to cables extending through the table top passage and a closed position preventing access thereto.

5. The table assembly of claim 4, wherein the cover defines a lower end mounted to the housing below the one or more power supply receptacles, and an upper end selectively engageable with engagement structure provided on the underside of the table top.

6. The table assembly of claim 5, wherein the cover includes hinge structure located adjacent its lower end for providing movement of the cover between its open and closed positions.

7. A table assembly, comprising:

a table top defining an upper surface and a lower surface;

leg structure interconnected with the table top for supporting the table top above a supporting surface;

a power and communication structure located adjacent the table lower surface, including an axially extending housing defining first and second ends and wall structure defining axial power supply and communication passages isolated from each other throughout the length of the housing for receiving power supply and communication cables, respectively; and an access cover interconnected between the power and communication structure and the lower surface of the table, the access cover being movable between a closed position preventing access to the power supply and communication passages and an open position providing access thereto.

8. The table assembly of claim 7, wherein the table top includes a passage for routing one or more cables from above the table top to below the table top, and wherein the table top passage is located between the housing and the access cover so that the access cover functions to enclose cables extending below the table top when the access cover is in its closed position.

9. The table assembly of claim 8, wherein the access cover includes a lower end mounted to the power and communication structure, an upper end releasably engaged with engagement structure provided on the table top lower surface, and hinge structure providing movement of the access cover between its open and closed positions.

10. The table assembly of claim 9, wherein the hinge structure comprises a living hinge formed integrally with the access cover.

11. A modular table system, comprising:

a table top having a length and width selecting according to the requirements of an end user;

a power supply system including a housing defined at least in part by an extrusion member having a length determined according to the length of the table top, one or more power supply cables received within the housing, and a power supply receptacle mounted to the housing and interconnected with the one or more power supply cables; and support structure for supporting the table top above a supporting surface, including a leg interconnected with and depending from the table top and terminating in a lower end, an axial foot member having a length selected according to the width of the table top, and mounting structure for mounting the foot member to the leg, wherein the mounting structure includes a mounting member separate from the leg and separate from the foot member, wherein the mounting member has a length less than the length of the foot member and includes an upper connection arrangement for securement to the lower end of the leg and a lower connection arrangement for securement to the foot member.

12. The modular table system of claim 11, wherein the table top defines first and second side edges, and wherein the extrusion member defines a pair of spaced open ends, each of which is located adjacent one of the table top side edges.

13. A table assembly, comprising:

a table top defining an upper surface and a lower surface;

a power supply system disposed below the table top and including a housing defining an internal passage for receiving one or more power supply cables and one or more power supply receptacles mounted to the housing;

leg structure interconnected with the table top for supporting the table top above a supporting surface, wherein the leg structure includes a tubular leg member defining an upper end located adjacent the power supply system housing and a lower end disposed therebelow, the tubular leg member including a passage extending between its upper and lower ends; and structure establishing communication between the power supply system housing passage and the tubular leg member passage for routing one or more power supply cables between the housing and the tubular leg member, the tubular leg member further including an opening located toward its lower end for routing the one or more power supply cables externally thereof.

14. The modular table system of claim 13, further comprising a closure engageable with the extrusion member for enclosing the first and second passages, wherein the power supply receptacle is mounted to the closure, and further comprising a communication receptacle interconnected with the one or more communication cables and mounted to the closure.

15. The modular table system of claim 11, wherein the lower connection structure comprises a series of threaded fasteners extending through the axial foot member into engagement with threaded passages provided in the mounting member, and wherein the upper connection structure comprises one or more threaded fasteners extending between the mounting member and one or more threaded passages provided toward the lower end of the leg.

16. The modular table system of claim 11, wherein the axial foot member defines first and second ends, and further comprising an end cap member engaged with each end of the axial foot member.

17. The modular table system of claim 16, wherein the axial foot member comprises a tubular member defining first and second open ends, and wherein the end cap includes a first internal portion adapted for placement within one of the open ends of the axial foot member and engaged with the axial foot member for mounting the end cap thereto, and a second external portion extending outwardly from the open end of each axial foot member and engageable with the supporting surface for supporting the table assembly thereabove.

18. The modular table system of claim 17, further comprising a glide member engaged with the external portion of each end cap member engageable with the supporting surface, and an adjustment member interposed between the end cap member external portion and the glide member for leveling the table top.

19. The modular table system of claim 11, wherein the leg defines an upper portion located adjacent the power supply system housing and a lower portion spaced therebelow and an internal passage extending between the upper and lower portions, and further comprising structure associated with the leg upper portion and the power supply system housing for providing communication between the leg internal passage and the power supply system housing for routing one or more power supply cables through the leg internal passage to the leg lower portion.

20. The modular table system of claim 19, further comprising an opening formed in the leg lower portion for enabling one or more power cables to pass from the leg internal passage, and grommet structure mounted to the leg over the opening.

21. The modular table system of claim 11, wherein the leg is located toward the rearward end of the table top, and wherein the support structure further includes an arm member mounted to the leg adjacent an upper end defined by the leg and extending forwardly therefrom for engaging the underside of the table top, and wherein the leg is engaged with the axial foot member via the mounting structure toward a rearward end defined by the axial foot member, wherein a portion of the mounting structure extends forwardly of the leg toward the forward end of the axial foot member.

22. A leg assembly for supporting a table above a supporting surface, the table including a table top, comprising:

a leg member defining a lower end and an upper end engageable with the table top;

an axially extending foot member defining an upper surface and a lower surface facing the supporting surface; and a mounting member separate from the leg member and separate from the foot member, the mounting member being engaged with the lower end of the leg member and with the upper surface of the foot member for securing the leg member and the foot member together to form the leg assembly, wherein the mounting member has a length less than the length of the foot member and includes an upper connection arrangement for securement to the lower end of the leg member and a lower connection arrangement for securement to the foot member.

23. The leg assembly of claim 22, wherein the foot member comprises an axially extending member defining first and second open ends between which the upper and lower surfaces extend, and further comprising an end cap mounted to the foot member adjacent each of its ends, wherein each end cap includes a first portion adapted for insertion within the foot member open end and a second portion extending outwardly from the open end and engageable with the supporting surface.

24. The leg assembly of claim 23, wherein the first portion of each end cap is mounted to the foot member via one or more threaded fasteners extending between and interconnecting the foot member with the end cap first portion.

25. The leg assembly of claim 23, further comprising an engagement member mounted to the second portion of each end cap for vertical adjustment relative thereto for use in leveling the table.

26. The leg assembly of claim 22, wherein the upper connection arrangement includes one or more downwardly facing threaded passages provided in the leg member lower end, and one or more threaded fasteners extending through the mounting member and into engagement with the threaded passages.

27. The leg assembly of claim 26, wherein the lower connection arrangement includes a series of downwardly facing threaded passages provided in the mounting member, and a series of threaded fasteners extending through the foot member into engagement with the threaded passages.

28. A table assembly, comprising:

a table top defining an upper surface, and underside, spaced front and rear edges and spaced side edges;

leg structure interconnected with the table top for supporting the table top above a supporting surface;

a power supply housing disposed below the table top and defining an internal passage within which one or more power supply cables are located;

one or more first power supply receptacles mounted to the housing and facing in a first direction toward the front edge of the table top, wherein the first power supply receptacles are accessible from below the front edge of the table top; and one or more second power supply receptacles mounted to the housing and facing in a direction toward the rear edge of the table top, wherein the second power supply receptacles are accessible from below the rear edge of the table top.

29. A table system comprising a series of side-by-side table assemblies, each table assembly comprising:

a table top;

leg structure interconnected with the table top for supporting the table top above a supporting surface;

a power supply housing disposed below the table top and defining an internal passage;

a pair of spaced electrical connectors disposed within the housing;

electrical power cable means extending between and interconnected with the spaced electrical connectors for providing electrical power thereto;

one or more power supply receptacles mounted to the housing, wherein each power supply receptacle is interconnected with one of the electrical connectors for supplying electrical power to the power supply receptacle; and a jumper interconnected with at least one electrical connector of a first table assembly and at least one electrical connector of an adjacent table assembly for communicating electrical power between the table assemblies.

* * * * *

UNITED STATES PATENT AND TRADEMARK OFFICE

CERTIFICATE OF CORRECTION

PATENT NO. : 6,202,567 B1
DATED : March 20, 2001
INVENTOR(S) : David R. Funk et al.

It is certified that error appears in the above-identified patent and that said Letters Patent is hereby corrected as shown below:

Column 12, line 55-Column 13, line 7,
Delete existing claim 13 and substitute therefor -- 13. The modular table system of claim 12, wherein the housing defines a first passage within which the one or more power supply cables are received, and a second passage for receving one or more communication cables. --

Column 13,
Line 9, delete “engageable” and substitute therefor -- engaged --;
Line 39, delete “engageable” and substitute therefor -- engagement --;

Column 14,
Lines 2 and 4, delete “structure” and substitute therefor -- member --.

Signed and Sealed this

Sixth Day of May, 2003

JAMES E. ROGAN
*Director of the United States Patent and Trademark Office*